US012616869B2

(12) United States Patent
Daoust

(10) Patent No.: US 12,616,869 B2
(45) Date of Patent: May 5, 2026

(54) WEIGHTLIFTING AND STRENGTH TRAINING EXERCISE EQUIPMENT

(71) Applicant: Pierre Marc Daoust, Grand Junction, CO (US)

(72) Inventor: Pierre Marc Daoust, Grand Junction, CO (US)

( * ) Notice: Subject to any disclaimer, the term of this patent is extended or adjusted under 35 U.S.C. 154(b) by 141 days.

(21) Appl. No.: 17/902,813

(22) Filed: Sep. 3, 2022

(65) Prior Publication Data

US 2024/0075335 A1 Mar. 7, 2024

(51) Int. Cl.

| | |
|---|---|
| ***A63B 21/00*** | (2006.01) |
| ***A63B 21/06*** | (2006.01) |
| ***A63B 21/16*** | (2006.01) |
| ***A63B 23/04*** | (2006.01) |

(52) U.S. Cl.

CPC ..... *A63B 21/4034* (2015.10); *A63B 21/06* (2013.01); *A63B 21/0615* (2013.01); *A63B 21/16* (2013.01); *A63B 23/0405* (2013.01); *A63B 23/047* (2013.01)

(58) Field of Classification Search

CPC . A63B 21/4034; A63B 21/06; A63B 21/0615; A63B 21/16; A63B 23/0405; A63B 23/047; A63B 2225/093; A63B 17/04; A63B 1/00; A63B 17/00; A63B 21/00; A63B 69/34; A63B 22/20; A62C 99/0081; B62B 17/02

See application file for complete search history.

(56) References Cited

U.S. PATENT DOCUMENTS

| | | | | |
|---|---|---|---|---|
| 5,050,868 | A * | 9/1991 | Pearson | A63B 21/0626 482/94 |
| 5,312,314 | A | 5/1994 | Stephan | |
| 7,112,164 | B1 | 9/2006 | Hoagland | |
| 9,227,101 | B2 | 1/2016 | Maguire | |
| 10,576,322 | B2 * | 3/2020 | Schlegel | A63B 23/1227 |
| 11,179,591 | B1 | 11/2021 | Bazargan | |
| 12,257,476 | B1 * | 3/2025 | Record | A63B 21/4005 |
| 2020/0238127 | A1 * | 7/2020 | Wehrell | A63B 21/40 |
| 2021/0339082 | A1 | 11/2021 | Bartley | |

FOREIGN PATENT DOCUMENTS

| | | | | |
|---|---|---|---|---|
| DE | 202015100538 U1 * | 5/2015 | | B62B 13/16 |

* cited by examiner

*Primary Examiner* — Megan Anderson
*Assistant Examiner* — Jacqueline N L Loberiza
(74) *Attorney, Agent, or Firm* — Hall Estill Law Firm

(57) ABSTRACT

A weightlifting and strength training apparatus intended for a full body workout. The weightlifting apparatus combines the weightlifting aspects of a yoke with the resistance training of a sled.

8 Claims, 1 Drawing Sheet

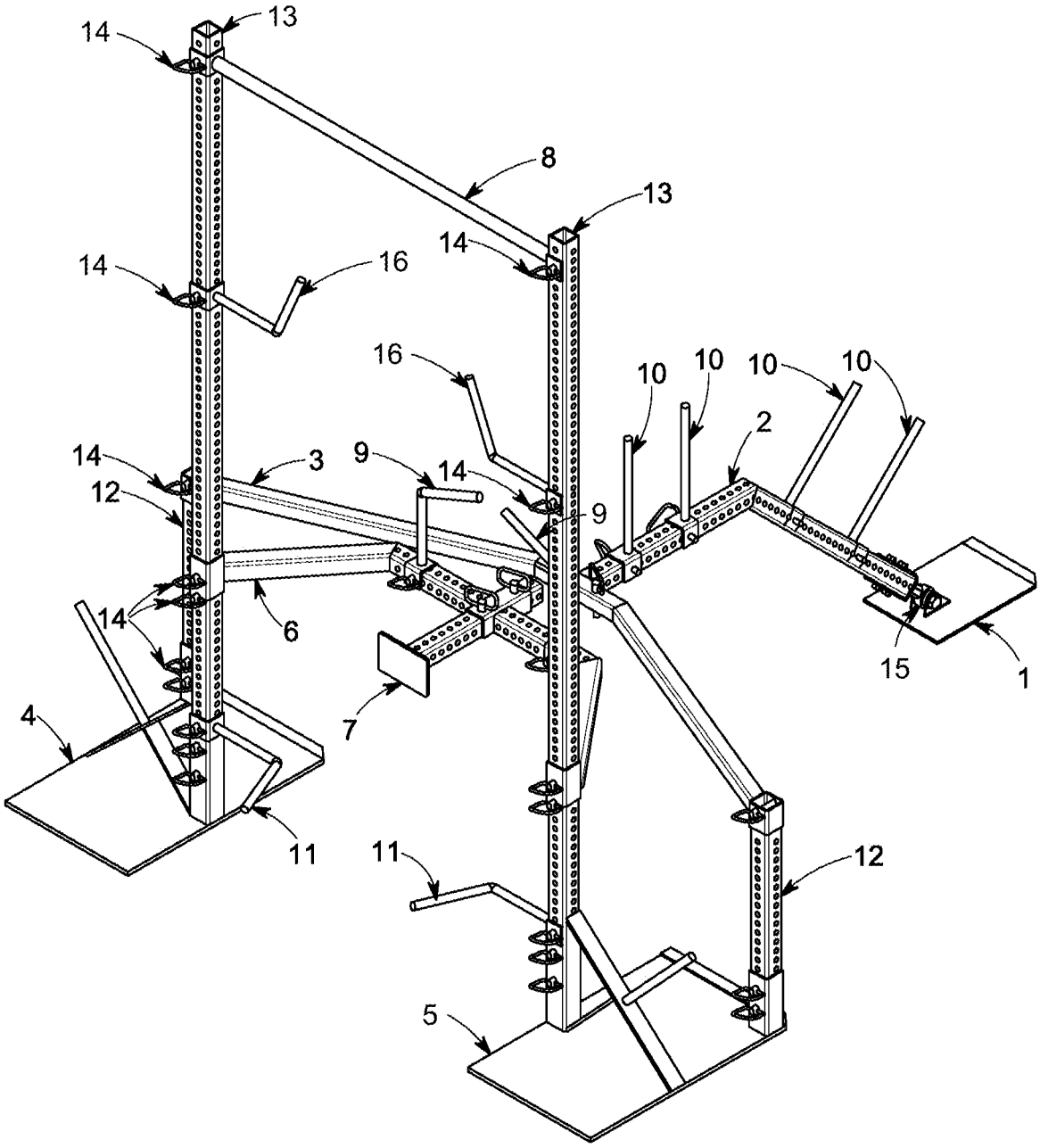
13
14
8
13
14
14
16
16
10
10
10
10
2
14
3
9
14
12
9
14
6
15
1
7
4
11
11
12
5

WEIGHTLIFTING AND STRENGTH TRAINING EXERCISE EQUIPMENT

BACKGROUND OF THE INVENTION

Technical Field

The present invention relates to weightlifting and strength training equipment. Weightlifting and strength training has many health benefits for an individual. As a result, many individuals try working out every day to maintain physical fitness.

The user can perform a variety of different exercises at his or her discretion with the present invention. The user can perform an exercise routine. Strength and endurance promote good physical fitness. Weightlifting is used to build muscular strength. Muscular endurance is increased by performing repetitions with smaller amount of weight. A variety of exercise machines are available; however, most people lack the space for multiple machines.

It is an object of the present invention to provide an exercise machine that has the ability to allow the user to both weight lift and strength train in a smaller space than the usual multiple machines now required to accomplish the same tasks. The exercise equipment enables the user to perform a variety of different exercises.

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions.

Athletic trainers throughout the country have begun to realize the critical role strength training plays with regard to their athlete's goals of overall physical fitness. A problem arises when gyms have limited funding, space, or both.

Definitions

1 is the Rear Plate;
2 is the Rear Strut;
3 is the Central Strut;
4 is the Left Skid Plate;
5 is the Right Skid Plate;
6 is the Front Lift Bar;
7 is the Push Plate;
8 is the Pull-Up Bar;
9 refers to Handles A;
10 refers to Weight Pegs;
11 refers to Handles B;
12 refers to 2×0.125 inch Tube A;
13 refers to 2×0.125 inch Tube B;
14 refers to Locking Pins for a 0.5 inch hole;
15 refers to a hinge point between the Rear Plate 1 and the Rear Strut 2; and
16 refers to Handles C.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Resistance mechanism as used herein means any device configured to resist the movement of a weight sled when a force is applied to the weight sled. Resistance mechanisms include, but are not limited to, mechanical brakes, anchors, weights, or devices that create friction with a ground surface.

Wheel as used herein means any circular mechanism for bearing weight and allowing the weight to roll across a surface. Non-limiting examples of wheels according to this definition are solid wheels, spoked wheels, wheels with tires of various sorts, rail wheels for use on tracks, track wheels for use in guiding continuous belts, treads, or track mechanisms, and roller-bearing wheels. While most wheels will bear the weight on an axle running through the center of the wheel perpendicular to the circular shape, in the case of roller-bearing wheels, the weight may be borne on the outer surface of the wheel against bearings, or in some cases against bearings on the inner surface of an open circular wheel.

Lever, as used herein, is a machine consisting of a beam pivotable at a fixed hinge, or pivot, called a fulcrum. A lever is a rigid body capable of rotating on a point on itself.

Some embodiments provide for holding one or more weights. A weight can be of any suitable material (e.g., metal, rubber, plastic, composite, and combinations thereof). A standard Olympic lifting weights, or "bumper," has an external circumference that is rubber and an inner circumference that is a metal plate, configured to allow movement onto and off of a barbell. Olympic weightlifting bumpers also often have different widths based on the heaviness of the weight. For example, a 25 kg plate will have a larger width than a 20 kg plate, which will have a larger width than a 15 kg plate, which will have a larger width than a 10 kg plate, which will have a larger width than a 5 kg plate. However, each of these different weight plates can have the same circumference and diameter.

Terms relating to circular shapes as used herein, such as diameter or radius, should be understood not to require perfect circular structures, but rather should be applied to any suitable structure with a cross-sectional region that can be measured from side-to-side. Terms relating to shapes, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations. Likewise, shapes modified by the word "generally" (e.g., "generally rectangular") can include reasonably close approximations of the stated shape.

EMBODIMENTS

In one embodiment, the exercise equipment is a weightlifting apparatus.

In one embodiment, the exercise equipment is a strength training apparatus.

In one embodiment, the exercise equipment is a weightlifting apparatus and a strength training apparatus.

In one embodiment, the exercise equipment has multiple handles or bars to provide different lifting methods.

In one embodiment, the exercise equipment has a chest piece, 7, to push upon while holding the weight In one embodiment, the exercise equipment has weights loaded from front and/or back.

In one embodiment, the exercise equipment can hold a plurality of weights

In one embodiment, the exercise equipment can hold 1, 2, 3, 4, 5, 6, 7, 8, 9, 10, or more weights.

In one embodiment, the exercise equipment has a back portion which can be pushed to slide on the ground.

In one embodiment, the exercise equipment has a back portion which can be lifted off the ground and carried while the front slides on the ground.

In one embodiment, the exercise equipment can be lifted by the back with weights to increase the difficulty.

In one embodiment, the exercise equipment can have weights loaded on the front to create friction to increase the resistance.

In one embodiment, the exercise equipment combines the lifting of weights with walking forward against the friction of the front which is loaded with weights.

In one embodiment, the exercise equipment combines the lifting of weights off the ground and pushing the weight against the resistance caused by friction with the ground or through any mechanism adding resistance either a wheel, a ski or any other form method in contact with the ground.

The machine combines both methods of resistance. Either they can slide the entire machine on the ground like a sled or the weight in the back can be lifted and carried while the front drags on the ground against the friction provided by the front weight. It includes multiple bars and handles to lift the weight for different techniques and exercises. There is a bar/chest pad that allows the ability to push the weight from the center of the body to maximize forward force while the hands are busy holding on to the weight.

While this disclosure describes certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The exercise equipment may provide a plurality of grooves and/or spaces for a user to place his/her hands and/or fingers. Inclusion of groove and/or space may reduce a time required for the user to achieve equilibrium of the weightlifting bar. Weightlifting bar may include handles that may be color-coordinated in some embodiments of the present disclosure.

It should be appreciated that groove and/or space may prevent users from improperly utilizing weightlifting bar or weight equipment system by providing guidelines to ensure symmetry of user hands and/or fingers along weightlifting bar. Symmetry and security of user hands and/or fingers along weightlifting bar may prevent injury to users and may provide ease of properly utilizing weightlifting bar. It should be appreciated that weightlifting bar may have any size or shape without departing from the present disclosure.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

It should be understood that embodiments of the invention include hardware components or modules that, for purposes of discussion, may be illustrated and described as if the components were implemented solely in hardware. It should be noted that hardware devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification, the singular forms "a," "an," and "the" include plural referents unless the content clearly dictates otherwise. The term "plurality" includes two or more unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied. Applicant has made this disclosure with respect to the current state of the art, but also contemplates advancements and that adaptations in the future may take into consideration of those advancements, namely in accordance with the then current state of the art.

It is intended that the scope of the invention be defined by the specification as written and equivalents as applicable. Reference to the singular is not intended to mean "one and only one" unless explicitly so stated. Moreover, no element, component, nor method or process step in this disclosure is intended to be dedicated to the public regardless of whether the element, component, or step is explicitly recited in the claims.

BRIEF DESCRIPTION OF THE DRAWINGS

FIG. 1 provides a perspective view of the apparatus.

DETAILED DESCRIPTION OF THE DRAWINGS

FIG. 1 illustrates how the push plate sequentially attaches to the front lift bar 6, pull-up bar 8, rear strut 2, rear plate 1, central strut 3, left skid plate 4, right skid plate 5, handle A 9, handle B 11, weight pegs 10, tube A 12, tube B 13, and locking pins 14.

What is claimed is:

1. A weightlifting and strength training apparatus comprising:

a push plate supported by a front lift bar;

a rear strut extending from a central strut, the rear strut having a horizontally disposed part and an angled part extending down to a rear plate;

a first tubing extending from a first skid plate and a second tubing extending from a second skid plate for supporting the central strut;

at least one handle extending from the front lift bar; and a third tubing extending from the first skid plate and a fourth tubing extending from the second skid plate, the third and fourth tubing cooperating to support the front lift bar.

2. The weightlifting and strength training apparatus as in claim 1, wherein the rear plate provides additional resistance while using the push plate to move the apparatus.

3. The weightlifting and strength training apparatus as in claim 1, wherein the first and second skid plates provide additional stability to the apparatus along with additional resistance while moving the apparatus with the push plate.

4. The weightlifting and strength training apparatus as in claim 1, wherein the rear plate is hingedly attached to the angled part of the rear strut.

5. The weightlifting and strength training apparatus as in claim 1, wherein a plurality of weight pegs allows for the user to increase the amount of exertion required to lift and move the apparatus.

6. The weightlifting and strength training apparatus as in claim 1, wherein additional stability is provided to the apparatus via a pull-up bar, the pull-up bar supported by the third and fourth tubing.

7. The weightlifting and strength training apparatus as in claim 1, wherein the push plate is removable from the front lift bar as to suit other exercises.

8. The weightlifting and strength training apparatus of claim 1, wherein a plurality of pins can be used to adjust a height of at least one handle, the push plate, a pull-up bar, and at least one weight peg.

* * * * *